US007300137B2

(12) United States Patent
Yamanaka et al.

(10) Patent No.: US 7,300,137 B2
(45) Date of Patent: Nov. 27, 2007

(54) LIQUID-DISCHARGE RECORDING HEAD

(75) Inventors: Akihiro Yamanaka, Yokohama (JP); Tomoyuki Inoue, Yokohama (JP); Torachika Osada, Yamato (JP); Michinari Mizutani, Kawasaki (JP); Hiroshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 152 days.

(21) Appl. No.: 11/219,116

(22) Filed: Sep. 2, 2005

(65) Prior Publication Data

US 2006/0050107 A1 Mar. 9, 2006

(30) Foreign Application Priority Data

Sep. 7, 2004 (JP) ..... 2004-259629

(51) Int. Cl.
*B41J 2/15* (2006.01)

(52) U.S. Cl. ..... 347/40; 347/12; 347/15; 347/43

(58) Field of Classification Search ..... 347/12, 347/15, 40, 43
See application file for complete search history.

(56) References Cited

U.S. PATENT DOCUMENTS 5,208,605 A * 5/1993 Drake ..... 347/15
5,412,410 A * 5/1995 Rezanka ..... 347/15
6,137,502 A * 10/2000 Anderson et al. ..... 347/15
6,309,051 B1 10/2001 Koitabashi et al.
6,375,294 B1 * 4/2002 Kneezel ..... 347/9
6,409,318 B1 * 6/2002 Clark ..... 347/65
6,652,079 B2 * 11/2003 Tsuchii et al. ..... 347/65

FOREIGN PATENT DOCUMENTS

JP 8-183179 7/1996

* cited by examiner

*Primary Examiner*—Lamson Nguyen
*Assistant Examiner*—Justin Seo
(74) *Attorney, Agent, or Firm*—Canon U.S.A. Inc I.P. Div

(57) ABSTRACT

A liquid-discharge recording head includes large nozzles for discharging large liquid drops and medium and small nozzles for discharging medium and small liquid drops that are smaller than the large liquid drops. The large nozzles are arranged on one side of an ink-supply opening and the medium and small nozzles are arranged on the other side of the ink-supply opening. The number of large nozzles is greater than the number of medium and small nozzles, and the liquid-discharge recording head performs high-speed printing using the large nozzles, high-speed photo printing using the medium and small nozzles, and high-quality photo printing using the small nozzles.

2 Claims, 8 Drawing Sheets

LIQUID-DISCHARGE RECORDING HEAD

BACKGROUND OF THE INVENTION

1. Field of the Invention

The present invention relates to liquid-discharge recording heads which discharge liquid for recording, and more particularly relates to a liquid-discharge recording head which discharges liquid drops of different volumes for recording.

2. Description of the Related Art

Resolution of color inkjet printers using thermal inkjet technology is increasing every year. In particular, in recording heads for forming images, resolution of nozzle arrays for discharging ink drops has increased to 600 dpi and 1200 dpi.

In addition, the volume of ink drops discharged for forming images is reduced every year in order to reduce the granularity of half-tone areas in grayscale images and middle-tone and highlight areas in color photo images. In particular, in recording heads for discharging color ink, the volume of ink drops has been reduced from about 15 pl to 5 pl and 2 pl.

However, when rough images, such as color graphs in charts, are printed and the required resolution is relatively low, high-resolution recording heads which discharge small ink drops cannot satisfy demands for high-speed printing. This is because the amount of image output data is large due to small drop size and high resolution and a long data transmission time is necessary.

In order to solve this problem, images may be formed with relatively large ink drops and small output data size in high-speed printing. In high-quality printing, the size of the ink drops may be changed so as to make the granularity in images as low as possible. Accordingly, there is a demand to change the size of ink drops of each color using a recording head that has a nozzle group for discharging ink drops of different sizes.

In order to satisfy this demand, Japanese Patent Laid-Open No. 8-183179 (corresponding to U.S. Pat. No. 6,309,051), for example, discloses a structure for discharging ink drops of different sizes from the same nozzle. In this structure, electrothermal transducers of different sizes are arranged in an ink passage which communicates with the nozzle, and ink drops of different sizes are discharged from the nozzle by selectively causing the electrothermal transducers to generate bubbles.

In addition, U.S. Pat. No. 6,137,502 discloses an inkjet recording head in which nozzles for discharging large ink drops and nozzles for discharging small ink drops are alternately arranged in two lines.

However, in the structure according to Japanese Patent Laid-Open No. 8-183179, since the ink drops of different sizes are discharged from the same ink passage, the ink supply speed at which the ink is supplied from behind the nozzle differs depending on the size of the discharged ink drops. Therefore, in a serial recording device, it is difficult to discharge ink drops of different sizes in a single recording-head scanning period (in a single scan). Accordingly, the recording head must scan a plurality of times to selectively discharge large, medium, and small ink drops. This means that ink drops of different sizes cannot be discharged at the same frequency, and therefore it is difficult to perform drop-size modulation control when high-definition images are formed.

In addition, in the structure according to U.S. Pat. No. 6,137,502, the same number of large and small nozzles is provided. Therefore, although high-speed printing using large amounts of ink can be performed without any problem when the amount of discharge is set large, the image quality is reduced in high-quality tone printing (photo printing). In addition, although the image quality can be increased in photo printing when the amount of discharge is set small, the print speed is reduced since the number of print passes is increased.

SUMMARY OF THE INVENTION

The present invention is directed to a liquid-discharge recording head which forms a high-quality image at a high speed.

According to one aspect of the present invention, a liquid-discharge recording head includes a liquid-supply opening through which liquid is supplied and a plurality of nozzles through which the liquid supplied from the liquid-supply opening is discharged for recording, the nozzles being arranged on both sides of the liquid-supply opening. The nozzles include a first nozzle group, a second nozzle group smaller in diameter than the first nozzle group, and a third nozzle group smaller in diameter than the second nozzle group. In addition, a number of nozzles of the first nozzle group is greater than a number of nozzles of the second and third nozzle groups.

Accordingly, the inkjet recording head of this embodiment performs high-speed printing (single pass) with large dots, high-speed photo printing (double pass) with medium and small dots, and high-quality photo printing with small dots.

In addition, according to another aspect of the present invention, a liquid-discharge recording head includes a liquid-supply opening through which liquid is supplied and a plurality of nozzles through which the liquid supplied from the liquid-supply opening is discharged for recording, the nozzles being arranged on both sides of the liquid-supply opening. The nozzles include a first nozzle group, a second nozzle group smaller in diameter than the first nozzle group, and a third nozzle group smaller in diameter than the second nozzle group. In addition, the nozzles of the first nozzle group are arranged only on one side of the liquid-supply opening while the nozzles of the second nozzle group and the nozzles of the third nozzle group are alternately arranged on the other side of the liquid-supply opening. A density of the alternately arranged nozzles of the second and third nozzle groups being twice a density of the nozzles of the first nozzle group.

Accordingly, the inkjet recording head of this embodiment also performs high-speed printing (single pass) with large dots and high-quality photo printing with small dots. In addition, since the density of the medium and small nozzles is twice the density of the large nozzles, high-speed photo printing (single pass) with medium and small dots can be performed without largely reducing the scan speed of a carriage.

Thus, according to the present invention, both high-speed printing and high image-quality photo printing can be performed in both of the above-described aspects. In addition, since the nozzles for discharging large, medium, and small liquid drops are arranged on both sides of a single liquid-supply opening, the above-mentioned print modes may be performed at low cost without increasing the size of the recording head.

Further features of the present invention will become apparent from the following description of exemplary embodiments with reference to the attached drawings.

DESCRIPTION OF THE EMBODIMENTS

Embodiments of the present invention will be described below with reference to the drawings.

Figure 8:
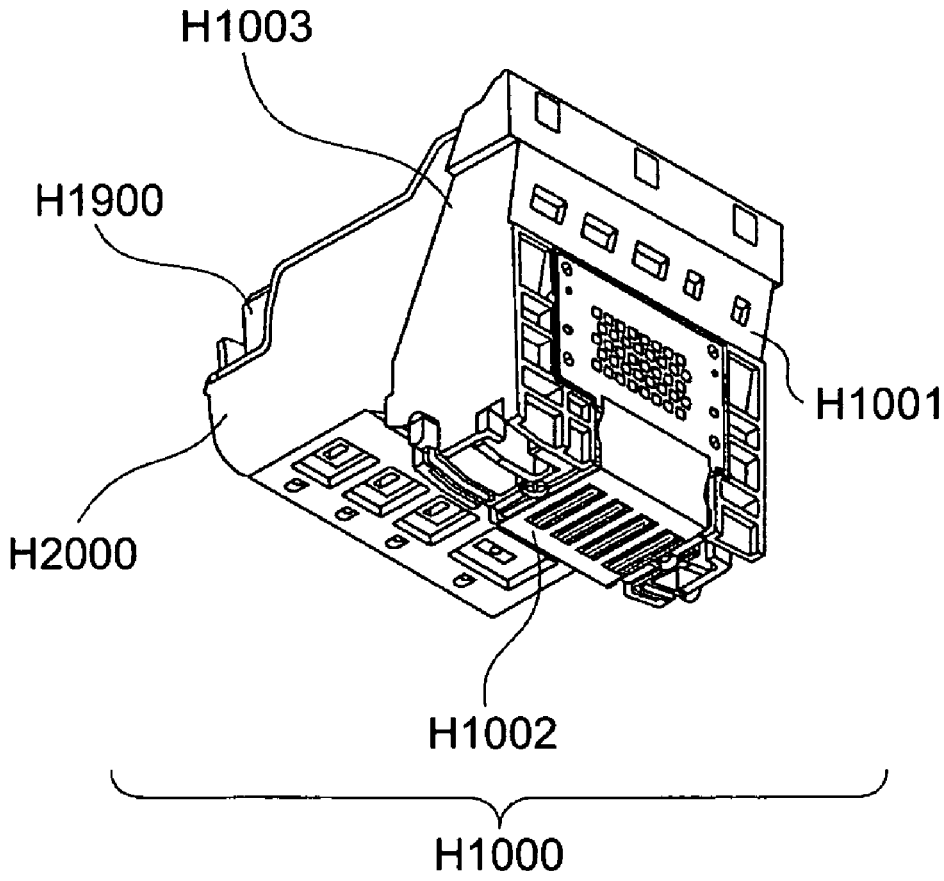
FIG. 8 is a perspective view of a recording cartridge to which the present invention can be applied.
Figure 9:
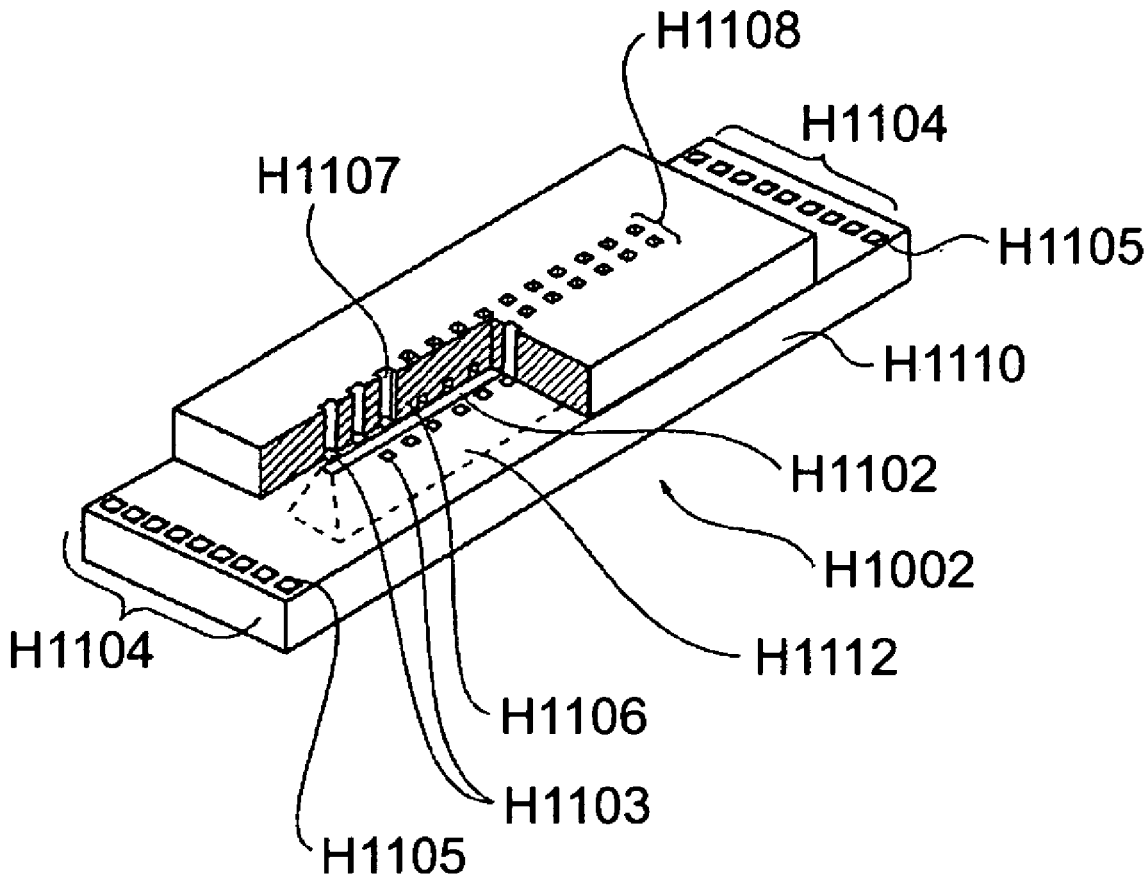
FIG. 9 is a partially cut-out perspective view showing the structure of a recording-element substrate to which the present invention can be applied.

FIGS. 8 and 9 are perspective views illustrating a recording-head cartridge, a liquid-discharge recording head, and an ink reservoir to which the present invention can be applied.

A liquid-discharge recording head (hereafter simply called a recording head) according to the embodiments of the present invention is included in a recording-head cartridge. More specifically, as shown in FIG. 8, a recording-head cartridge H1000 includes a recording head H1001 and an ink reservoir (hereafter called an ink tank) H1900 detachably attached to the recording head H1001 to supply ink to the recording head H1001. The recording head H1001 records characters, images, etc., on a recording medium by discharging liquid, such as ink, supplied from the ink tank H1900 in accordance with recording information.

The recording-head cartridge H1000 is detachably attached to a carriage included in a recording device. The recording-head cartridge H1000 is electrically connected to the carriage with a connection terminal provided on the carriage, and is supported by being fixed to the carriage at a predetermined position with a positioning member provided on the carriage.

The recording head H1001 performs a recording process using heating elements, e.g., electrothermal transducers, which generate thermal energy for causing film boiling in ink in accordance with electrical signals. As shown in FIG. 8, the recording head H1001 includes a recording-element unit H1002, an ink-supply unit H1003, and a tank holder H2000 for holding the ink tank H1900.

The recording-element unit H1002 is used for recording characters, images, etc., on recording media, such as recording paper. The ink-supply unit H1003 supplies ink contained in the ink tank H1900 to the recording-element unit H1002. The tank holder H2000 detachably holds the ink tank H1900.

In the embodiments, the recording-element unit H1002 includes four recording-element sections for respectively discharging black, cyan, magenta, and yellow ink supplied from corresponding chambers in the ink tank H1900.

FIG. 9 shows a partially cut-out perspective view in which a part of one of the recording-element sections is removed to explain the structure of the recording-element unit H1002. In the recording element section shown in FIG. 9, a plurality of electrothermal transducers H1103 used for discharging ink and electric wiring made of Al (aluminum) or the like for supplying electricity to the electrothermal transducers H1103 are formed on a Si (silicon) substrate H1110 with a thickness of about 0.5 mm to 1 mm by deposition. In addition, a plurality of ink passages and a plurality of nozzles H1107 corresponding to the electrothermal transducers H1103 are formed by photolithography. The ink passages communicate with a common liquid chamber H1112 having an ink-supply opening H1102 for supplying ink.

The common liquid chamber H1112 having the ink-supply opening H1102 is formed by anisotropic etching or sandblasting using the crystal orientation of Si.

In addition, in the recording element section, the electrothermal transducers H1103 are arranged in two lines across the ink-supply opening H1102. The electrothermal transducers H1103 and the electric wiring made of Al or the like for supplying electricity to the electrothermal transducers H1103 are formed by deposition. In addition, electrodes H1104 for supplying electricity to the electric wiring are arranged at positions outside the area in which the electrothermal transducers H1103 are formed. Bumps H1105 made of Au (gold) or the like are formed on the electrodes H1104 by heat ultrasonic bonding. In addition, ink passage walls H1106 that define the ink passages and the nozzles H1107 are formed in the Si substrate H1110 by photolithography using a resin material. Accordingly, a nozzle group H1108 is provided. Since the nozzles H1107 are disposed at positions corresponding to the electrothermal transducers H1103, ink supplied from the ink-supply opening H1102 to the ink passages is discharged through the nozzles H1107 by bubbles generated by the heating effect of the electrothermal transducers H1103.

Each embodiment of the present invention will be described below. In each diagram for explaining the arrangement of nozzles, only one recording element section is illustrated. The arrangement of the nozzles illustrated in each diagram may be applied to all of the recording element sections or to only one recording element section corresponding to a particular color (for example, black or colors other than black).

First Embodiment

Figure 1:
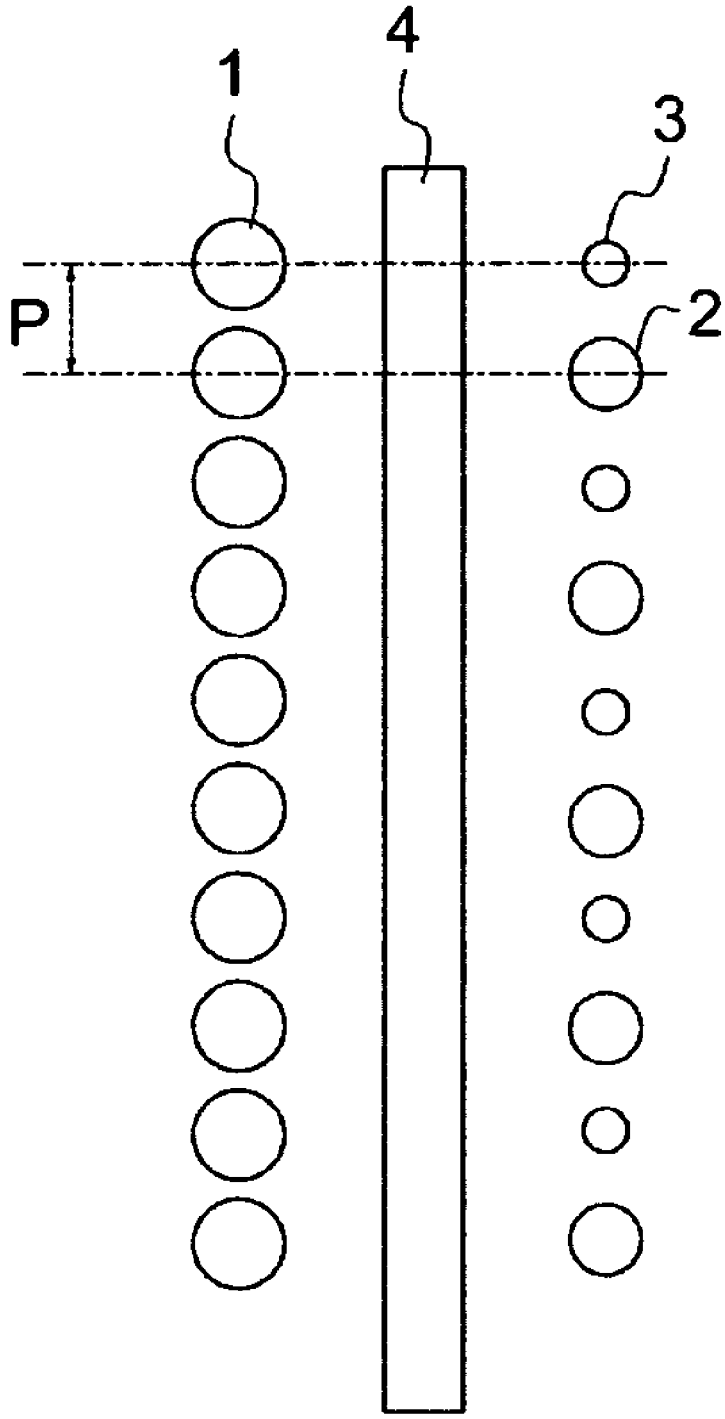
FIG. 1 is a diagram illustrating an arrangement of nozzles according to a first embodiment of the present invention.

FIG. 1 is a schematic diagram illustrating an arrangement of nozzles according to a first embodiment of the present invention.

According to the present embodiment, a first nozzle group includes nozzles 1 having the largest diameter, a second nozzle group includes nozzles 2 having a diameter smaller than that of the nozzles 1, and a third nozzle group includes nozzles 3 having the smallest diameter. The largest ink drops are discharged from the nozzles 1 of the first nozzle group and the smallest ink drops are discharged from the nozzles 3 of the third nozzle group. Accordingly, the nozzles 1, 2, and 3 of the first, second, and third nozzle groups are hereafter called large, medium, and small nozzles, respectively. In addition, ink drops discharged from the large, medium, and small nozzles 1, 2, and 3 are hereafter called large, medium, and small ink drops, respectively.

In the present embodiment, the nozzles are arranged on both sides of an ink-supply opening 4. A line of the large nozzles 1 for discharging large ink drops is on one side of the ink-supply opening 4, and a line in which the medium and small nozzles 2 and 3 for discharging medium and small ink drops, respectively, are alternately arranged on the other side of the ink-supply opening 4.

The ink-supply opening 4 and the nozzles 1 to 3 correspond to the ink-supply opening H1102 and the nozzles H1107, respectively, in FIG. 9. To facilitate understanding, only ten nozzles are shown along each line in FIG. 1.

The amount of discharge from the large, medium, and small nozzles 1, 2, and 3 varies depending on an arrangement pitch P of the nozzles, the properties of the ink, etc. In the first embodiment, the arrangement pitch P of the nozzles corresponds to 600 dpi, and the amount of discharge from the large, medium, and small nozzles are 12 pl, 4.5 pl, and 1.5 pl, respectively.

Figure 2:
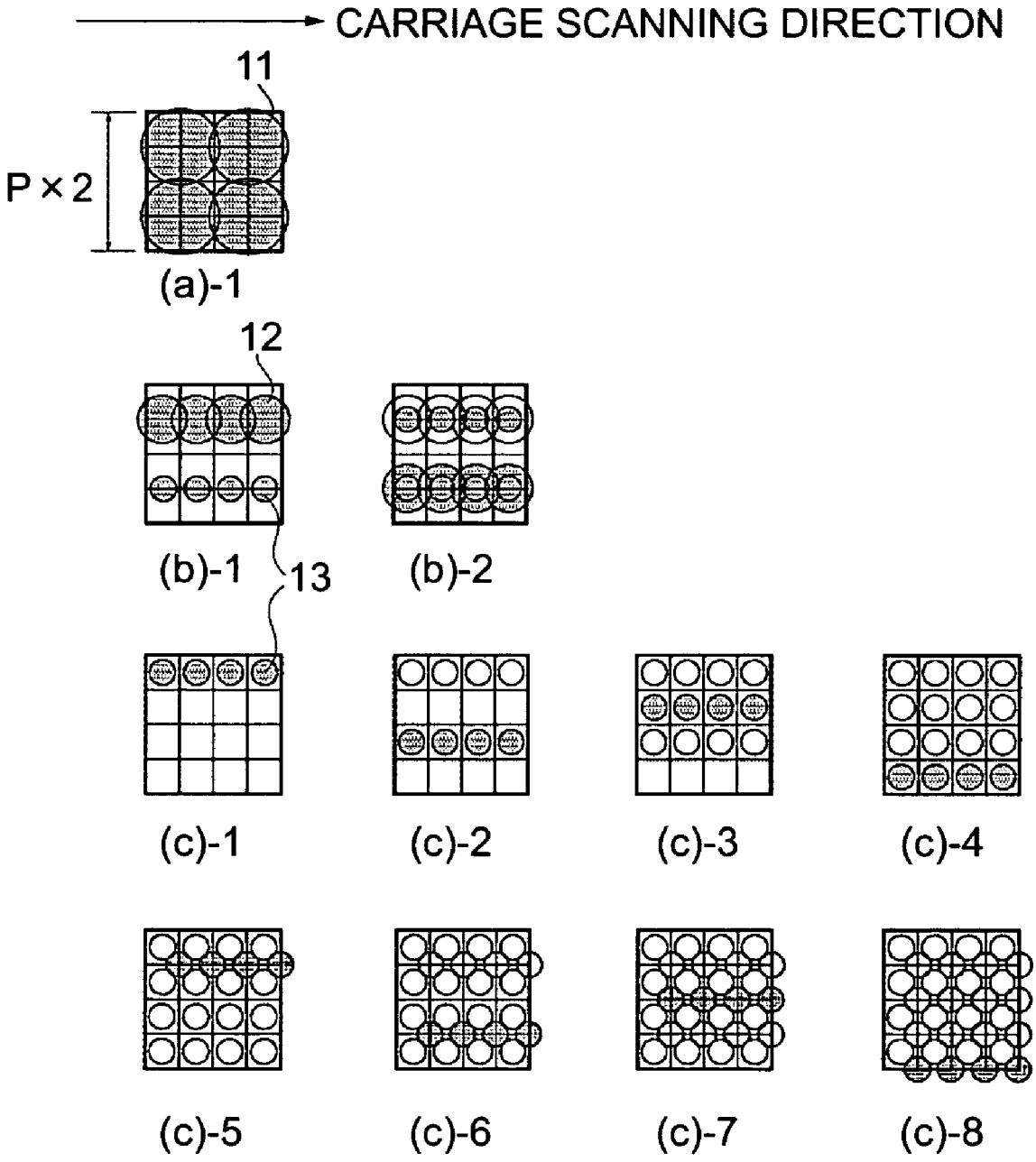
FIG. 2 is a diagram illustrating the manner in which dots are formed in each print mode using a liquid discharge recording head according to the first embodiment of the present invention.

FIG. 2 shows the manner in which dots are formed in each print mode using a recording head according to the present embodiment. In FIG. 2, (*a*)-1 shows a print pattern in high-speed printing, such as color printing on normal paper, (*b*)-1 and (*b*)-2 show a print pattern in high-speed photo printing, and (*c*)-1 to (*c*)-8 show a print pattern in high-quality photo printing. The numbers attached to (*a*), (*b*), and (*c*) indicate the pass number in multi-pass printing. The shaded dots are printed in the current pass, and white dots are printed in previous passes. To facilitate understanding, square areas with sides corresponding to two pitches (300 dpi square) are shown in FIG. 2, and the illustrated dots are smaller than their actual sizes.

The manner in which the dots are formed in each print mode will be described in detail with reference to FIG. 2.

As described above, in FIG. 2, (*a*)-1 shows the print pattern in high-speed printing, such as color printing on normal paper, and the print pattern includes only large dots 11 formed by the large nozzles 1. As shown in FIG. 1, the large nozzles 1 are arranged at the pitch P. Therefore, as shown by (*a*)-1, two dots are simultaneously formed along a side corresponding to two pitches. Then, the next two dots are formed at positions shifted by one pitch P in the scanning direction. Thus, in this print mode, a desired amount of ink (100%) is supplied in a single pass. Four large dots 11 are formed in the pixel area with sides corresponding to two pitches, and accordingly the total amount of ink supplied is calculated as 4×12 pl=48 pl.

In addition, as described above, (*b*)-1 and (*b*)-2 show the print pattern in high-speed photo printing, and the print pattern includes medium and small dots 12 and 13 formed by the medium and small nozzles 2 and 3, respectively. As shown in FIG. 1, the medium and small nozzles 2 and 3 are alternately arranged at the pitch P. Therefore, as shown by (*b*)-1, one medium dot 12 and one small dot 13 are simultaneously formed along a side corresponding to two pitches. Then, the next pair of dots is formed at positions shifted by one-half of the pitch P in the scanning direction. Accordingly, 600 dpi×1200 dpi printing is performed in a first pass. The discharge frequency at which the ink drops are discharged largely depends on the size of the ink drops (amount of discharge). More specifically, as the size of the ink drops is reduced, the time required for supplying the ink (refill time) is reduced and printing can be performed at a higher frequency. In this print mode, since the large nozzles 1 for forming the large dots 11 are not used, the frequency can be increased compared to that in the print mode shown by (*a*)-1 in which the large dots 11 are formed. According to an example of the present embodiment, the drive frequency in the print mode shown by (*a*)-1 was 15 kHz, while the drive frequency in the print mode shown by (*b*)-1 and (*b*)-2 was 30 kHz, that is, twice the drive frequency in the print mode shown by (*a*)-1. This means that the scan speed of the carriage may be set the same as that in the print mode shown by (*a*)-1. Next, as shown by (*b*)-2, a recording medium is conveyed by a distance corresponding to the product of the pitch P and an odd number, and the small and medium dots 13 and 12 are formed on the medium and small dots 12 and 13, respectively, in a second pass. In this print mode, a desired amount of ink (100%) is supplied in two passes without reducing the scan speed of the carriage. Accordingly, high-speed photo printing is performed. In this print mode, eight medium dots 12 and eight small dots 13 are formed in the pixel area with sides corresponding to two pitches, and accordingly the total amount of ink supplied is calculated as 8×(4.5+1.5) pl=48 pl, which is the same as that in the print mode shown by (*a*)-1.

In addition, as described above, (*c*)-1 to (*c*)-8 show the print pattern in high-quality photo printing, and the print pattern includes only small dots 13 formed by the small nozzles 3. As shown in FIG. 1, the medium and small nozzles 2 and 3 are alternately arranged at the pitch P. Therefore, as shown by (*c*)-1, one line of the small dots 13 is formed along a side corresponding to two pitches in a first pass. In this print mode, since only the small dots 13 are formed, the print frequency can, of course, be set higher than that in the print mode shown by (*b*)-1 and (*b*)-2. According to an example of the present embodiment, in order to make the scan speed of the carriage constant, the frequency was set to 30 kHz, similar to the print mode shown by (*b*)-1 and (*b*)-2. Next, as shown by (*c*)-2, a recording medium is conveyed by a distance corresponding to the product of the pitch P and an odd number, and another line of the small dots 13 is formed in a second pass. Next, as shown by (*c*)-3, the recording medium is conveyed by a distance corresponding to one-half of the pitch P, and another line is formed in a third pass. Next, as shown by (*c*)-4, the recording medium is conveyed by a distance corresponding to the product of the pitch P and an odd number, and another line is formed in a fourth pass. Next, as shown by (*c*)-5, the recording medium is conveyed by a distance corresponding to one-fourth of the pitch P, and dots are formed at positions shifted by one-fourth of the pitch P in the scanning direction in a fifth pass. Then, as shown by (*c*)-6 to (*c*)-8, lines of dots are formed in sixth to eighth passes similar to the second to fourth passes shown by (*c*)-2 to (*c*)-4. Accordingly, 2400 dpi×2400 dpi printing is performed.

In the present embodiment, the dots printed in the passes shown by (*c*)-5 to (*c*)-8 are shifted from those printed in the passes shown by (*c*)-1 to (*c*)-4. However, since the actual dots are larger than those shown in FIG. 2, good print results can also be obtained when the dots printed in the passes shown by (*c*)-5 to (*c*)-8 are positioned directly on the dots printed in the passes shown by (*c*)-1 to (*c*)-4. In this print mode, a desired amount of ink (100%) is supplied in eight passes. Accordingly, high-quality photo printing is performed. In this print mode, thirty two small dots 13 are formed in the pixel area with sides corresponding to two pitches, and accordingly the total amount of ink supplied is calculated as 32×1.5 pl=48 pl, which is the same as those in the print mode shown by (*a*)-1 and the print mode shown by (*b*)-1 and (*b*)-2.

As described above, according to the present embodiment, an inkjet head includes nozzle groups corresponding to large, medium, and small amounts of discharge. The inkjet head can perform high-speed printing (single pass) since a large number of nozzles for forming large dots are provided. In addition, the inkjet head can also perform high-speed photo printing (double pass) with medium and small dots and high-quality photo printing with small dots.

Although the present embodiment has been described in detail, the amount of discharge of the large, medium, and small nozzles and the print modes are not limited to the values described in the present embodiment. For example, the number of passes in photo printing may also be reduced by performing tone printing using the large, medium, and small nozzles at the same time.

Second Embodiment

Figure 3A:
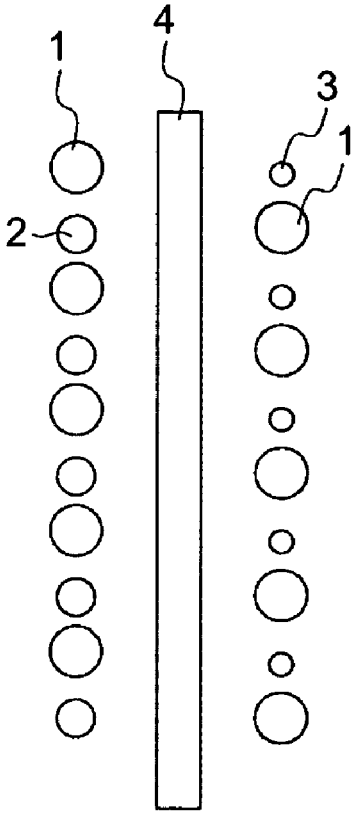
FIG. 3A is a diagram illustrating an arrangement of nozzles according to a second embodiment of the present invention.

FIG. 3A is a schematic diagram illustrating an arrangement of nozzles according to a second embodiment of the present invention. The present embodiment is characterized in that large nozzles 1 for forming large dots are arranged on both sides of an ink-supply opening 4. The number of large, medium, and small nozzles 1, 2, and 3 is the same as those in the first embodiment. More specifically, the number of large nozzles 1 for forming large dots is twice the number of medium and small nozzles 2 and 3 for forming medium and small dots, respectively. A line in which the large and medium nozzles 1 and 2 for forming large and medium dots, respectively, are alternately arranged is on one side of the ink-supply opening 4, and a line in which the large and small nozzles 1 and 3 for forming large and small dots, respectively, are alternately arranged on the other side of the ink-supply opening 4.

With regard to the manner in which the dots are formed, print modes similar to those shown in FIG. 2 may be applied since only the arrangement of the large, medium, and small nozzles with respect to the ink-supply opening is changed from that of the first embodiment. Accordingly, also in the present embodiment, an inkjet head includes nozzle groups corresponding to large, medium, and small amounts of discharge. The inkjet head can perform high-speed printing (single pass) since a large number of nozzles for forming large dots are provided. In addition, the inkjet head can also perform high-speed photo printing (double pass) with medium and small dots and high-quality photo printing with small dots.

In addition, in the present embodiment, the nozzles 1 for discharging a large amount of ink and the nozzles 2 (or the nozzles 3) for discharging a medium (or small) amount of ink are alternately arranged. Therefore, the adjacent nozzles are not used at the same time except for the print mode in which large dots and medium dots (or small dots) are formed simultaneously. In FIG. 2, (*a*)-1 show high-speed printing using only the large dots, (*b*)-1 and (*b*)-2 show high-speed photo printing using the medium and small dots, and (*c*)-1 to (*c*)-8 show high-quality photo printing using only the small dots. Therefore, the adjacent nozzles are not used at the same time in any of the three print modes. In a typical inkjet recording head, so-called crosstalk occurs in which the liquid discharge state changes when the nozzles near each other are driven at the same time. According to the present embodiment, the crosstalk is greatly reduced since the adjacent nozzles, which largely interfere with each other, are not used at the same time.

Figure 3B:
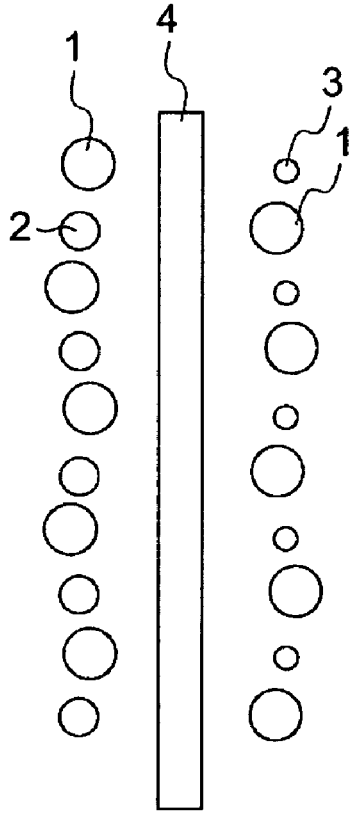
FIG. 3B is a diagram illustrating an arrangement of nozzles according to a modification of the second embodiment of the present invention.
Figure 3C:
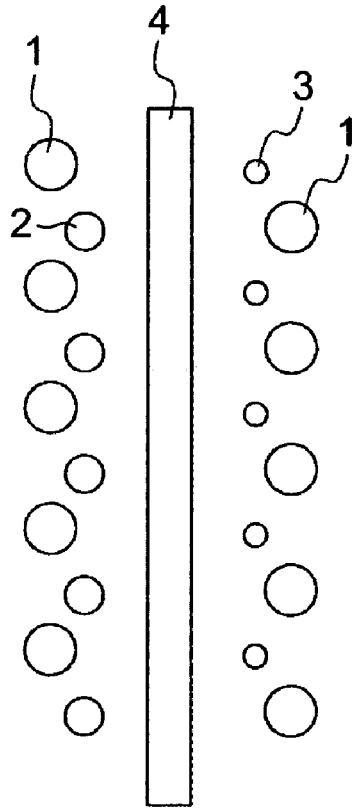
FIG. 3C is a diagram illustrating an arrangement of nozzles according to another modification of the second embodiment of the present invention.

FIGS. 3B and 3C show modifications of the second embodiment shown in FIG. 3A. In FIG. 3B, different from FIG. 3A, nozzles 1 for discharging a large amount of ink are shifted in accordance with the driving process. In a typical inkjet recording head, instead of discharging ink from all of the nozzles at the same time, the nozzles are divided into multiple groups and are driven in units of groups at different times in view of voltage reduction. When the nozzles are driven at different times, the positions at which the dots are formed are shifted as the carriage is moved. In the present embodiment, in order to cancel this shift, the nozzles 1 are disposed at positions shifted in accordance with the driving process. Although not shown in the figure, the shapes of the ink-injecting portions of the nozzles are adjusted such that the nozzles have the same refill time. In addition, in the present modification, only the nozzles 1 for forming large dots, which are most likely to be noticeable when they are displaced, are shifted. However, the medium and small nozzles may, of course, also be shifted in accordance with the driving process.

In FIG. 3C, different from FIG. 3A, medium and small nozzles 2 and 3 are arranged alternately with large nozzles 1 in a zigzag manner. In this modification, the medium and small nozzles 2 and 3 are positioned nearer to an ink-supply opening 4 than the large nozzles 1. Accordingly, the refill times of the medium and small nozzles 2 and 3 are reduced, and the print frequencies in the print mode shown by (*b*)-1 and (*b*)-2 and the print mode shown by (*c*)-1 to (*c*)-8 in FIG. 2 can be increased. Accordingly, photo printing can be performed at a higher speed. In the present modification, the medium and small nozzles 2 and 3 are positioned nearer to the ink-supply opening 4 than the large nozzles 1. However, the large nozzles 1 may, of course, also be positioned nearer to the ink-supply opening 4 so that single-pass, high-speed printing shown by (*a*)-1 in FIG. 2 can be performed at a higher speed.

Third Embodiment

Figure 4:
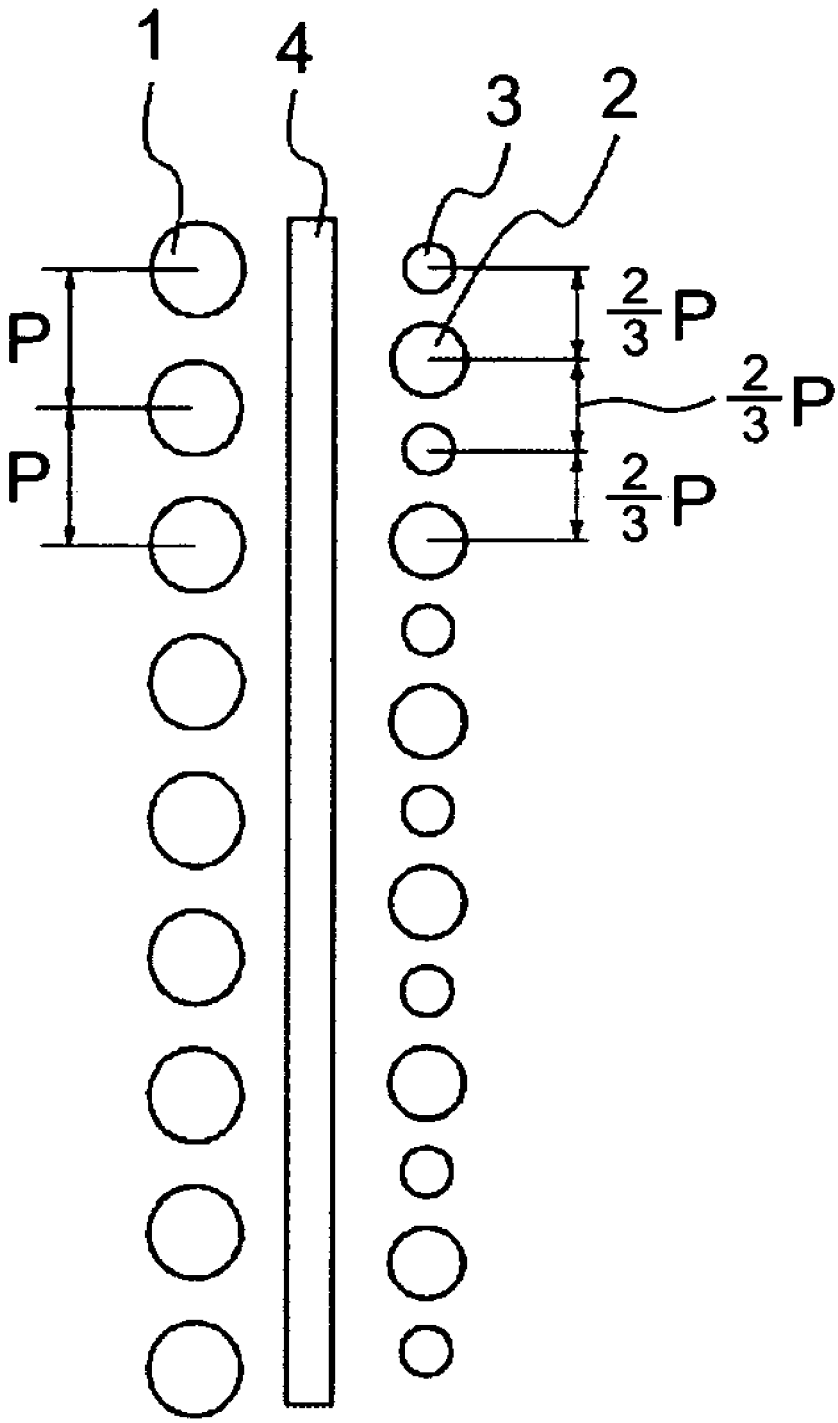
FIG. 4 is a diagram illustrating an arrangement of nozzles according to a third embodiment of the present invention.

FIG. 4 is a schematic diagram illustrating an arrangement of nozzles according to a third embodiment of the present invention. The present embodiment is characterized in that the density of medium and small nozzles 2 and 3 is higher than that of large nozzles 1. In the present embodiment, the arrangement pitch P of the large nozzles 1 corresponds to 600 dpi, and the arrangement pitch of the medium and small nozzles 2 and 3 corresponds to 900 dpi.

When the density of the medium and small nozzles 2 and 3 is set higher than that of the large nozzles 1 as in the present embodiment, high-speed photo printing using the medium and small nozzles 2 and 3 may be performed in a single pass, as described below.

Fourth Embodiment

Figure 5A:
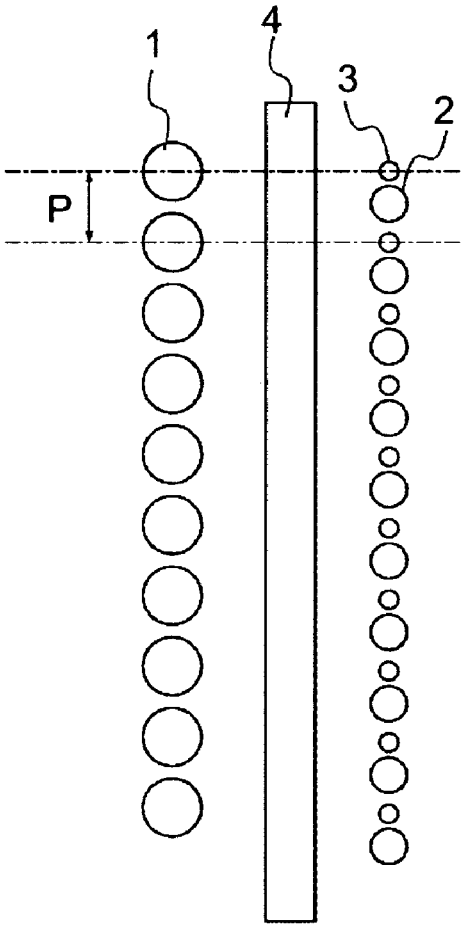
FIG. 5A is a diagram illustrating an arrangement of nozzles according to a fourth embodiment of the present invention.

FIG. 5A is a schematic diagram illustrating an arrangement of nozzles according to a fourth embodiment of the present invention.

In the present embodiment, a plurality of nozzles are arranged on both sides of an ink-supply opening 4. A line of large nozzles 1 for forming large dots is on one side of the ink-supply opening 4, and a line in which medium and small nozzles 2 and 3 for forming medium and small dots, respectively, are alternately arranged on the other side of the ink-supply opening 4. The nozzles are arranged such that the density of the medium and small nozzles 2 and 3 is twice the density of the large nozzles 1. Electrothermal transducers for forming medium and small dots may be smaller than those for forming large dots. Accordingly, the size of transistors that drive the electrothermal transducers for forming the medium and small dots may also be small. In addition, the sizes of the medium and small nozzles are, of course, also small. Therefore, the nozzles may be arranged such that the density of the medium and small nozzles 2 and 3 is higher than that of the large nozzles 1 as in the present embodiment.

The amount of discharge from the large, medium, and small nozzles 1, 2, and 3 vary depending on an arrangement pitch P of the nozzles, the properties of the ink, etc. In the present embodiment, the arrangement pitch P of the large nozzles 1 corresponds to 600 dpi, and the arrangement pitch of the medium and small nozzles 2 and 3 corresponds to 1200 dpi. The amount of ink discharged for forming the large, medium, and small dots are 12 pl, 4.5 pl, and 1.5 pl, respectively.

Figure 6:
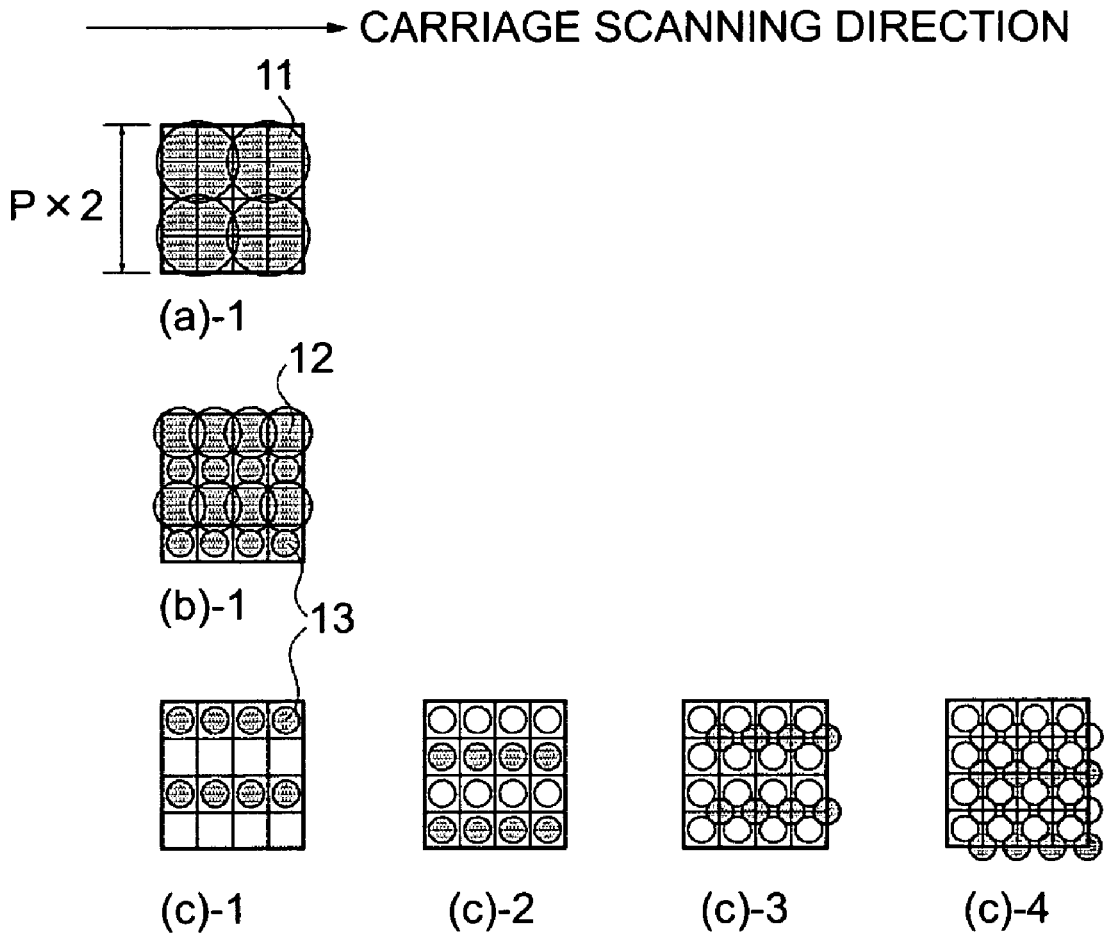
FIG. 6 is a diagram illustrating the manner in which dots are formed in each print mode using a liquid discharge recording head according to the fourth embodiment of the present invention.

FIG. 6 shows the manner in which dots are formed in each print mode using a recording head according to the present embodiment. In FIG. 6, (*a*)-1 shows a print pattern in high-speed printing, such as color printing on normal paper, (*b*)-1 shows a print pattern in high-speed photo printing, and (*c*)-1 to (*c*)-4 show a print pattern in high-quality photo printing. The numbers attached to (*a*), (*b*), and (*c*) indicate the pass number in multi-pass printing. The shaded dots are printed in the current pass, and white dots are printed in previous passes. To facilitate understanding, square areas with sides corresponding to two pitches (300 dpi square) are shown in FIG. 6, and the illustrated dots are smaller than their actual sizes.

The manner in which the dots are formed in each print mode will be described in detail with reference to FIG. 6.

As described above, in FIG. 6, (*a*)-1 shows the print pattern in high-speed printing, such as color printing on normal paper, and the print pattern includes only large dots 11 formed by the large nozzles 1. As shown in FIG. 1, the large nozzles 1 are arranged at the pitch P. Therefore, as shown by (*a*)-1, two dots are simultaneously formed along a side corresponding to two pitches. Then, the next two dots are formed at positions shifted by one pitch P in the scanning direction. Thus, in this print mode, a desired amount of ink (100%) is supplied in a single pass. Four large dots 11 are formed in the pixel area with sides corresponding to two pitches, and accordingly the total amount of ink supplied is calculated as 4×12 pl=48 pl.

In addition, as described above, (*b*)-1 shows the print pattern in high-speed photo printing, and the print pattern includes medium and small dots 12 and 13 formed by the medium and small nozzles 2 and 3, respectively. As shown in FIG. 5A, the medium and small nozzles 2 and 3 are alternately arranged at a pitch corresponding to one-half of the pitch P. Therefore, as shown by (*b*)-1, two medium dots 12 and two small dots 13 are simultaneously formed along a side corresponding to two pitches. Accordingly, 1200 dpi×1200 dpi printing is performed. The discharge frequency at which the ink drops are discharged largely depends on the size of the ink drops (amount of discharge). More specifically, as the size of the ink drops is reduced, the time required for supplying the ink (refill time) is reduced and printing can be performed at a higher frequency. In this print mode, since the large nozzles 1 for forming the large dots 11 are not used, the frequency can be increased compared to that in the print mode shown by (*a*)-1 in which the large dots 11 are formed. According to an example of the present embodiment, the drive frequency in the print mode shown by (*a*)-1 was 15 kHz, while the drive frequency in the print mode shown by (*b*)-1 was 24 kHz. Thus, according to this print mode, a desired amount of ink (100%) is supplied in a single pass without largely reducing the scan speed of the carriage from that in the print mode shown by (*a*)-1. Accordingly, high-speed photo printing is performed. In this print mode, eight medium dots 12 and eight small dots 13 are formed in the pixel area with sides corresponding to two pitches, and accordingly the total amount of ink supplied is calculated as 8×(4.5+1.5) pl=48 pl, which is the same as that in the print mode shown by (*a*)-1.

In addition, as described above, (*c*)-1 to (*c*)-4 show the print pattern in high-quality photo printing, and the print pattern includes only small dots 13 formed by the small nozzles 3. As shown in FIG. 5A, the medium and small nozzles 2 and 3 are alternately arranged at a pitch corresponding to one-half of the pitch P. Therefore, as shown by (*c*)-1, two lines of the small dots 13 are formed in a first pass. In this print mode, since only the small dots 13 are formed, the print frequency can, of course, be set higher than that in the print mode shown by (*b*)-1. According to an example of the present embodiment, the frequency was set to 30 kHz so that the scan speed of the carriage is set the same as that in the print mode shown by (*a*)-1. Next, as shown by (*c*)-2, a recording medium is conveyed by a distance corresponding to one-half of the pitch P, and another two lines of the small dots 13 are formed in a second pass. Next, as shown by (*c*)-3 in FIG. 6, the recording medium is conveyed by a distance corresponding to one-fourth of the pitch P, and dots are formed at positions shifted by one-fourth of the pitch P in the scanning direction in a third pass. Then, as shown by (*c*)-4, the recording medium is conveyed by a distance corresponding to one-half of the pitch P, and another two lines are formed in a fourth pass. Accordingly, 2400 dpi×2400 dpi printing is performed. In this case, the dots printed in the passes shown by (*c*)-3 and (*c*)-4 are shifted from those printed in the passes shown by (*c*)-1 and (*c*)-2. However, since the actual dots are larger than those shown in FIG. 6, good print results can also be obtained when the dots printed in the passes shown by (*c*)-3 and (*c*)-4 are positioned directly on the dots printed in the passes shown by (*c*)-1 and (*c*)-2. In this print mode, a desired amount of ink (100%) is supplied in four passes. Accordingly, high-quality photo printing is performed. In this print mode, thirty two small dots 13 are formed in the pixel area with sides corresponding to two pitches, and accordingly the total amount of ink supplied is calculated as 32×1.5 pl=48 pl, which is the same as those in the print modes shown by (*a*)-1 and (*b*)-1.

As described above, according to the present embodiment, an inkjet head includes nozzle groups corresponding to large, medium, and small amounts of discharge. The inkjet head can perform high-speed printing (single pass) since nozzles for forming large dots are arranged along a single line. In addition, the inkjet head can also perform high-speed photo printing (single pass) without largely reducing the scan speed of the carriage since the medium and small nozzles are arranged at a high density. In addition, high-quality photo printing may also be performed using small dots.

Figure 7:
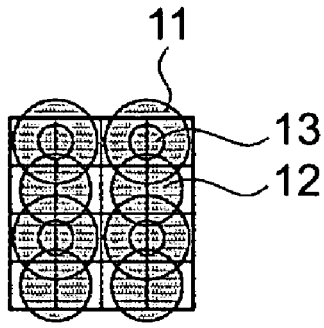
FIG. 7 is a diagram illustrating the manner in which dots are formed in another print mode using the liquid discharge recording head according to the fourth embodiment of the present invention.

Although the present embodiment has been described in detail, the amount of discharge of the large, medium, and small nozzles and the print modes are not limited to the values described in the present embodiment. For example, when the amount of discharge from the large nozzles is set to 6 pl, high-speed printing can be performed in a print mode shown in FIG. 7 instead of the high-speed printing mode shown by (*a*)-1 in FIG. 6. More specifically, as is clear from FIG. 7, since the amount of discharge from the large nozzles is reduced, the total amount of ink supplied is ensured by printing medium and small dots in addition to the large dots in high-speed print mode. In this case, four large dots, four medium dots, and four small dots are formed in the pixel area with sides corresponding to two pitches, and the total amount of ink supplied is calculated as 4×(6+4.5+1.5) pl=48 pl, which is the same as that in the print mode shown by (*a*)-1 in FIG. 6. Since the amount of discharge from the large nozzles is reduced, the refill time is reduced and printing can be-performed at a higher frequency. Therefore, the print speed can be further increased.

Figure 5B:
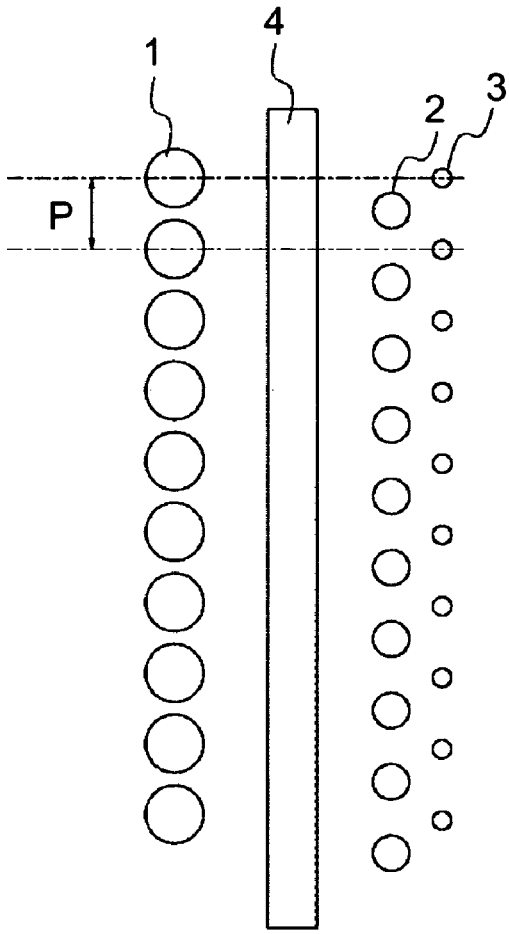
FIG. 5B is a diagram illustrating an arrangement of nozzles according to a modification of the fourth embodiment of the present invention.

FIG. 5B shows a modification of FIG. 5A, and is different from the fourth embodiment in that medium and small nozzles 2 and 3 are arranged in two lines. In this modification, the medium nozzles 2 are nearer to the ink-supply opening 4 than the small nozzles 3. Accordingly, the refill time of the medium nozzles 2 is reduced and printing can be performed at a high frequency in the mode shown by (*b*)-1 in FIG. 6. Accordingly, the print speed can be further increased in high-speed photo printing.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-259629 filed Sep. 7, 2004, which is hereby incorporated by reference herein in its entirety.

What is claimed is:

1. A liquid-discharge recording head comprising:

a liquid-supply opening through which liquid is supplied; and a plurality of nozzles through which the liquid supplied from the liquid-supply opening is discharged for recording, the nozzles being arranged on both sides of the liquid-supply opening, wherein the nozzles include a first nozzle group, a second nozzle group smaller in diameter than the first nozzle group, and a third nozzle group smaller in diameter than the second nozzle group, and wherein a number of nozzles in the first nozzle group is greater than a number of nozzles in each of the second and third nozzle groups, and wherein the nozzles of the first and second nozzle groups are alternately disposed on one side of the liquid-supply opening, and the nozzles of the first and third nozzle groups are alternately disposed on the other side of the liquid-supply opening.

2. The liquid-discharge recording head according to claim 1, wherein the nozzles of the first nozzle group are disposed at positions corresponding to time-division driving.

* * * * *